US006328540B1

(12) United States Patent
Kösters et al.

(10) Patent No.: US 6,328,540 B1
(45) Date of Patent: Dec. 11, 2001

(54) ROTARY PISTON COMPRESSOR WITH AN AXIAL DIRECTION OF DELIVERY

(75) Inventors: Heiner Kösters, Itzehoe; Guido Keller, Hagen, both of (DE)

(73) Assignee: Sterling Fluid Systems (Germany) GmbH, Itzehoe (DE)

( * ) Notice: Subject to any disclaimer, the term of this patent is extended or adjusted under 35 U.S.C. 154(b) by 0 days.

(21) Appl. No.: 09/590,974

(22) Filed: Jun. 9, 2000

(30) Foreign Application Priority Data

Jun. 19, 1999 (EP) ..... 99111232

(51) Int. Cl.[7] ..... F04B 39/06
(52) U.S. Cl. ..... 417/372; 417/410.4; 418/83
(58) Field of Search ..... 417/228, 372, 417/410.4; 418/83, 85

(56) References Cited

U.S. PATENT DOCUMENTS 3,478,689 * 11/1969 Ball ..... 417/372
4,767,284 * 8/1988 Shiinoki et al. ..... 417/410.4
5,222,874 * 6/1993 Unnewehr et al. ..... 417/372
5,904,473 * 5/1999 Dahmlos et al. ..... 417/410.4

FOREIGN PATENT DOCUMENTS 195 22 559 A 1 1/1997 (DE) .
197 45 616 A 1 4/1999 (DE) .

* cited by examiner

*Primary Examiner*—Michael Koczo
(74) *Attorney, Agent, or Firm*—Alix, Yale & Ristas, LLP

(57) ABSTRACT

The rotary piston machine with an axial direction of delivery from the top downwards, in particular of screw spindle-type construction, with cooling ducts (12) for the motors (8), bearings (7) and sensors (9), through which ducts a cooling fluid flows, and with a cooling device for the pump space (3) is characterized in that the casing (2) of the pump space (3) has a closed annular space (15) which is partially filled with a liquid, which is cooled by the cooling fluid via heat exchanger surfaces (18).

8 Claims, 1 Drawing Sheet

ROTARY PISTON COMPRESSOR WITH AN AXIAL DIRECTION OF DELIVERY

BACKGROUND OF THE INVENTION

The invention relates to a rotary piston compressor with an axial direction of delivery from the top downwards, in particular of screw spindle-type construction, with cooling ducts for the motors, bearings and sensors, through which ducts a cooling fluid flows, and with a cooling device for the pump space.

A known rotary piston compressor (DE 19522559 A1) of this kind has two screw spindles which intermesh and are driven synchronously by motors. Here, the angles of rotation and speeds of rotation of the two screw spindles or rotors are detected by sensors. The motors are synchronized electronically by means of the signals of these sensors. In the case of such rotary piston compressors, there is, on the one hand, the need to cool the motors, bearings and sensors, and they should be cooled to as low temperatures as possible, e.g. 20° C., although, of course, they should not be cooled down to such an extent that condensation forms. The pump space, which is heated up due to the compression of the medium delivered, must likewise be cooled. However, the pump space must be cooled to a higher temperature of, for example, 60° C. to avoid the pumped medium condensing.

In the case of the known rotary piston compressor, the motors, bearings and sensors are cooled by a cooling fluid which flows through cooling ducts. Although the pump space is cooled primarily by internal cooling of the screw spindles, provision has also been made in one embodiment for the casing of the pump space to be cooled. However, the corresponding cooling fluid must be at a higher temperature than the cooling fluid for the motors, bearings and sensors, making it necessary to have two separate cooling circuits. If the rotary piston compressor is to be serviced or repaired, two cooling circuits have to be divided and emptied. The cooling system is therefore complex and requires a considerable amount of work when disassembling the rotary piston compressor.

SUMMARY OF THE INVENTION

The object of the invention is to provide a rotary piston compressor by means of which it is possible in a particularly simple manner to cool the motors, bearings and sensors to a relatively low temperature and to cool the pump space to a considerably higher temperature, with the pump space at the same time being cooled to a greater extent on the delivery side than on the intake side.

The fact that the delivery side should be cooled to a greater extent than the intake side is likewise known from the prior art. According to the invention, the solution to the object, including this secondary problem, is achieved by virtue of the fact that the casing of the pump space has a closed annular space which is partially filled with a liquid, which is cooled by the cooling fluid via heat exchanger surfaces.

The pump space is thus cooled by a liquid which is contained within a closed annular space. In an advantageous embodiment, this annular space extends over the entire height of the casing of the pump space. The liquid contained in it is cooled by the cooling fluid for the motors, bearings and sensors. In this context, the rate of flow and size of the heat exchanger surfaces can be selected so that, although the motors, bearings and sensors are cooled to approximately 20° C., the casing of the pump space is cooled to a temperature of approximately 60° C. Since the annular space is only partially filled with liquid, cooling is less effective at the top, i.e. the intake zone, in line with the fact that there should be less cooling here. Moreover, since the annular space is only partially filled with liquid, this liquid can expand as it heats up. The liquid in the annular space does not have to be drained off when the casing is disassembled but remains in it. All that is required is to divide the circuit for the cooling fluid for the motors, bearings and sensors and, where appropriate, partially drain it.

In an embodiment which is particularly expedient and simple to produce, the annular space has a cooling coil through which cooling fluid flows.

It is expedient if the liquid in the annular space is a water/glycol mixture, which allows effective cooling but is not subject to the risk of freezing when the pump is unused at low temperatures.

It is expedient to use cooling water as the cooling fluid.

It is expedient here to make provision for the cooling fluid to flow through the cooling ducts for the motors, bearings and sensors first and then to flow through the cooling coil.

It is advantageous if the cooling ducts and the annular space are closed off, i.e. are not connected to the pump space, eliminating the need for a seal—with the familiar problems associated with it—which would otherwise be necessary.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
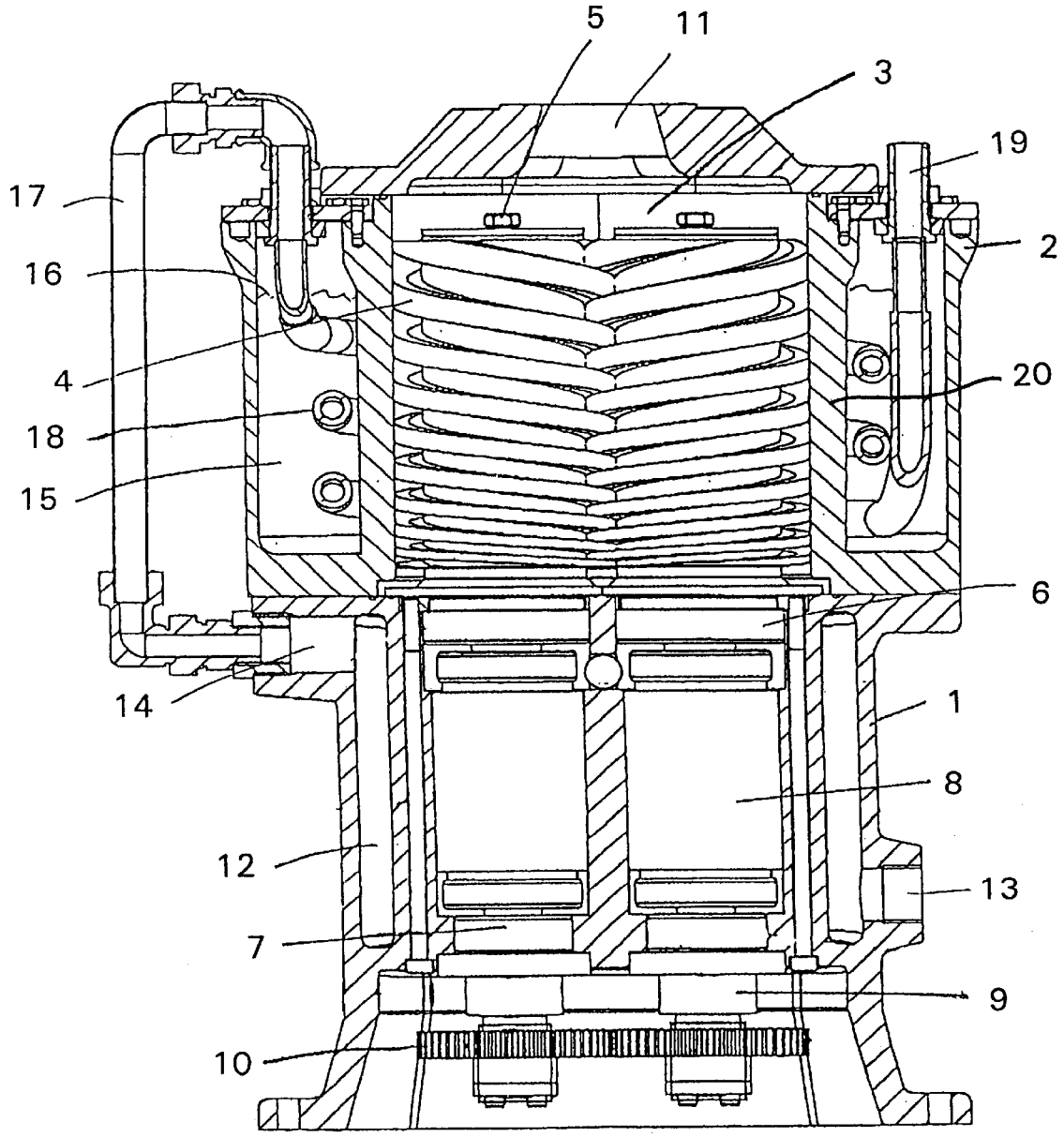
FIG. 1 is cross section view of a rotary piston compressor in accordance with the invention.

The rotary piston compressor has a motor casing 1 and a casing 2 belonging to the pump space 3.In the pump space there are two screw spindles 4, which are cantilever-mounted by shafts 5 supported by bearings 6, 7. The screw spindles 4 are driven in synchronous rotation by motors 8. For this purpose, the respective angular position of the shafts and screw spindles is determined with the aid of sensors 9 for angles of rotation, in which case electronic synchronization takes place, thus preventing the screw spindles 4 from touching one another. To prevent the intermeshing screw spindles 4 from touching one another in the event of adverse operating conditions and poor or completely absent synchronization, intermeshing gearwheels 10, the angular backlash of which is less than that of the screw spindles 4, are provided at the bottom on the shafts 5.

By virtue of the rotary motion, fluid to be delivered is drawn in at the top through an intake opening 11 and expelled downwards through an outlet opening (not shown).

The motors 8, bearings 6, 7 and sensors 9 are cooled by cooling water which is passed through cooling ducts 12 and enters these ducts 12 through an opening 13 and leaves the cooling ducts 12 again through an opening 14.

A cylinderical inner wall 20 and the casing 2 of the pump space 3 define an annular space 15 which is filled with a water/glycol mixture up to a level 16. The annular space 15 also contains a cooling coil 18, which is cooled by the cooling water, which leaves the motor casing 1through the opening 14 and is passed into the cooling coil 18 via a line 17 and then flows out again through the line 19. The casing 2 is thus cooled by the liquid in the annular space 15, which in turn is cooled by the cooling water, which has first of all cooled the motors 8, bearings 6, 7 and sensors 9. Since the annular space 15 is filled with cooling liquid only up to level 16, this liquid can expand when heated. The pump space on the (lower) delivery side is cooled to a greater extent than on the (upper) intake side. Since the cooling liquids are in enclosed spaces 12, 15, sealing with respect to the pump space 3 is not necessary. The familiar problems with such seals are therefore avoided.

What is claimed is:

1. Rotary piston compressor having an axial direction of delivery from the top downwards comprising:

a pump casing defining a pump space;

a cylindrical inner wall disposed within the pump space, the inner wall and the pump casing defining an annular space, the annular space being at least partially filled with a liquid;

a pump disposed within the inner wall;

at least one motor connected to the pump;

at least one bearing supporting the motor;

at least one motor sensor;

a cooling duct carrying a flow of cooling fluid for cooling the motor, the bearing, and the sensor; and heat exchange means in fluid communication with the cooling duct for carrying the cooling fluid within the annular space, wherein the cooling fluid cools the liquid in the annular space.

2. Rotary piston compressor according to claim 1, wherein the heat exchange means comprises a cooling coil, through which the cooling fluid flows, disposed within the annular space.

3. Rotary piston compressor according to claim 1 wherein the liquid in the annular space is a water/glycol mixture.

4. Rotary piston compressor according to claim 1 wherein the cooling fluid is cooling water.

5. Rotary piston compressor according to claim 2 wherein the cooling fluid flows through the cooling ducts for the motors, bearings and sensors first and then flows through the cooling coil.

6. Rotary piston compressor according to claim 1 wherein the annular space extends essentially over the entire height of the pump casing of the pump space.

7. Rotary piston compression according to claim 1 wherein the cooling ducts and the annular space are closed off from the pump space.

8. A rotary piston compressor having an axial direction of delivery from the top downwards comprising:

a pump casing defining a pump space;

a cylindrical inner wall disposed within the pump space, the inner wall and the pump casing defining an annular space, the annular space being at least partially filled with a liquid;

a screw spindle-type pump disposed within the inner wall;

at least one motor connected to the pump;

at least one bearing supporting the motor;

at least one motor sensor;

a cooling duct carrying a flow of cooling fluid for cooling the motor, the bearing, and the sensor; and heat exchange means in fluid communication with the cooling duct for carrying the cooling fluid within the annular space, wherein the cooling fluid cools the liquid in the annular space.

* * * * *